US007320821B2

(12) United States Patent
Prodoehl

(10) Patent No.: US 7,320,821 B2
(45) Date of Patent: Jan. 22, 2008

(54) THREE-DIMENSIONAL PRODUCT WITH DYNAMIC VISUAL IMPACT

(75) Inventor: Ellyne Elizabeth Prodoehl, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/700,131

(22) Filed: Nov. 3, 2003

(65) Prior Publication Data

US 2005/0095400 A1 May 5, 2005

(51) Int. Cl.
*B32B 3/00* (2006.01)
*B31F 1/07* (2006.01)
*D21H 11/00* (2006.01)

(52) U.S. Cl. ..... 428/174; 428/153; 428/156; 162/109

(58) Field of Classification Search ..... 428/153, 428/174, 175, 178, 179; 162/109
See application file for complete search history.

(56) References Cited

U.S. PATENT DOCUMENTS 3,227,598 A * 1/1966 Robb ..... 428/179
3,525,663 A * 8/1970 Hale ..... 428/179
4,184,700 A 1/1980 Greenaway
4,555,433 A * 11/1985 Jablonka et al. ..... 428/166
4,556,378 A 12/1985 Nyfeler et al.
4,717,221 A 1/1988 McGrew
4,758,296 A 7/1988 McGrew
4,759,967 A 7/1988 Bauernfeind
4,913,858 A 4/1990 Miekka et al.
4,933,120 A 6/1990 D'Amato et al.
4,984,824 A 1/1991 Antes et al.
5,155,604 A 10/1992 Miekka et al.
5,294,475 A 3/1994 McNeil
5,356,506 A 10/1994 McNeil et al.

(Continued)

FOREIGN PATENT DOCUMENTS

WO WO 03/035371 A1 5/2003

OTHER PUBLICATIONS

Hakle, Super Vlaush Toilet Paper Sample Sold 2003.

*Primary Examiner*—Donald J. Loney
(74) *Attorney, Agent, or Firm*—Betty J. Zea; Stephen T. Murphy; David M. Weirich

(57) ABSTRACT

The present invention relates to three-dimensional products comprising a structure having a first surface and a z-direction perpendicular to the first surface, the structure further comprising a base, a plurality of raised protrusion areas raised at least about 300 μm above the base of the structure, and a plurality of connecting elements, each connecting element ending at a raised protrusion and each connecting element raised above the base of the structure in the z-direction and at least partially recessed from the raised protrusions in the z-direction, wherein the connecting elements connect two of the raised protrusions areas; the plurality of raised protrusion areas and plurality of connecting elements together forming a pattern comprising at least a first sub-pattern region and second sub-pattern region; wherein the first sub-pattern region comprises a first set of parallel rows of raised protrusion areas and connecting elements and a second set of parallel rows of raised protrusions and connecting elements which are not parallel to the first set of parallel rows and the first sub-pattern region is structurally distinguishable from the second sub-pattern region.

8 Claims, 7 Drawing Sheets

U.S. PATENT DOCUMENTS

| | | | | |
|---|---|---|---|---|
| 5,468,323 | A | 11/1995 | McNeil | |
| 6,030,690 | A | 2/2000 | McNeil et al. | |
| D423,232 | S | 4/2000 | Reid | |
| 6,086,715 | A | 7/2000 | McNeil | |
| 6,113,723 | A | 9/2000 | McNeil et al. | |
| 6,129,972 | A | 10/2000 | McNeil et al. | |
| D438,017 | S | 2/2001 | Reid | |
| 6,193,918 | B1 | 2/2001 | McGuire et al. | |
| 6,203,664 | B1 | 3/2001 | Oriaran et al. | |
| 6,277,466 | B1 | 8/2001 | McNeil et al. | |
| 6,395,133 | B1 | 5/2002 | McNeil | |
| 6,461,720 | B1 * | 10/2002 | Graff | 428/154 |
| 6,468,392 | B2 | 10/2002 | Oriarian et al. | |
| 2002/0180097 | A1 | 12/2002 | Giachetto et al. | |
| 2003/0021953 | A1 | 1/2003 | Graff | |

* cited by examiner

THREE-DIMENSIONAL PRODUCT WITH DYNAMIC VISUAL IMPACT

FIELD OF THE INVENTION

This invention relates to three-dimensional products having a structure which provides an improved aesthetic image having a dynamic visual impact.

BACKGROUND OF THE INVENTION

The creation of three-dimensional images on the surface of products to improve the product's aesthetic appeal is well known in the art. Specifically, the embossing of paper products to create such an image on the surface of the paper products has been done for many years. It is also known that embossing makes those paper products more absorbent, softer and bulkier.

The idea that by having an image change depending on the angle at which it is viewed is also not new. The use of lenticular lenses or diffraction gratings in combination with multiple images to create holograms have fully developed this idea. However, the use of such lenses or gratings is costly and often impractical for more the aesthetic improvement of more simple products.

The present invention relates to a specific set of characteristics of three-dimensional structures that result in an image that changes character depending on the angle at which it is viewed without the addition of films, lenses, or gratings.

SUMMARY OF THE INVENTION

The present invention relates to a three-dimensional product comprising a structure having a first surface and a z-direction perpendicular to the first surface, the structure further comprising a base, a plurality of raised protrusion areas raised at least about 300 μm above the base of the structure, and a plurality of connecting elements, each connecting element ending at a raised protrusion and each connecting element raised above the base of the structure in the z-direction and at least partially recessed from the raised protrusions in the z-direction, wherein the connecting elements connect two of the raised protrusions areas; the plurality of raised protrusion areas and plurality of connecting elements together forming a pattern comprising at least a first sub-pattern region and second sub-pattern region; wherein the first sub-pattern region comprises a first set of parallel rows of raised protrusion areas and connecting elements and a second set of parallel rows of raised protrusions and connecting elements which are not parallel to the first set of parallel rows and the first sub-pattern region is structurally distinguishable from the second sub-pattern region.

DETAILED DESCRIPTION OF THE INVENTION

Figure 1:
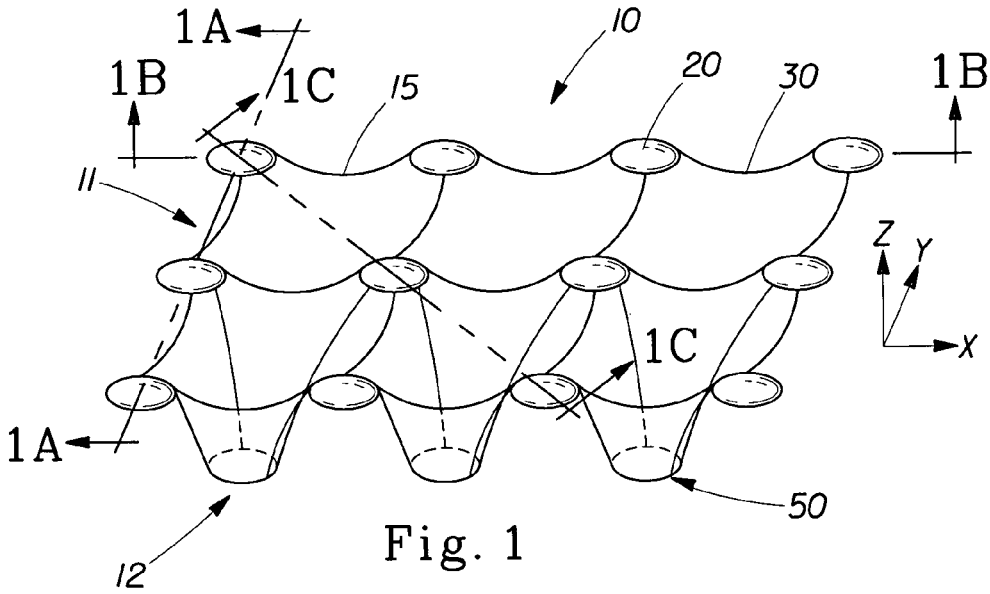
FIG. 1 is a schematic representation of an embodiment of a three-dimensional product according to the present invention having a structure which provides a dynamic visual image on the surface of the product.
Figure 1A:
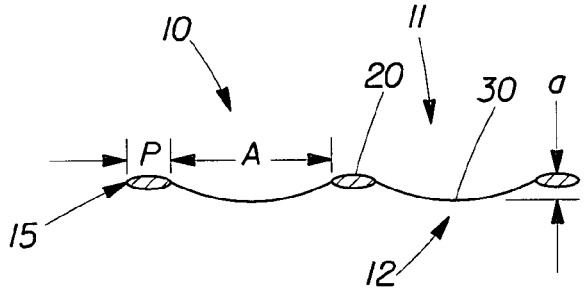
FIGS. 1A-A, 1B-B, and 1C-C are cross-sectional views of the three-dimensional product of FIG. 1.
Figure 1B:
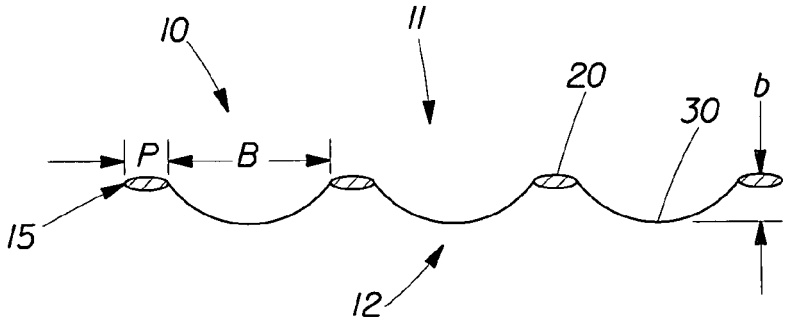

The present invention relates to three-dimensional products having an optically dynamic image. Optically dynamic images are such that they convey more than one image to the human eye depending on the orientation at which the product is being viewed, and/or on the angle and intensity of the lighting.

The present invention is a three-dimensional product 10 comprising a structure 15 having a first surface 11 and a z-direction perpendicular to the first surface 11. The structure 15 further comprises a base 50, a plurality of raised protrusion areas 20 raised at least about 300 μm above the base of the structure, and a plurality of connecting elements 30, each connecting element 30 ending at a raised protrusion 20 and each connecting element 30 raised above the base 50 of the structure 15 in the z-direction and at least partially recessed from the raised protrusions 20 in the z-direction. The connecting elements 30 connect two of the raised protrusions areas 20. The plurality of raised protrusion areas 20 and plurality of connecting elements 30 together form a pattern comprising at least a first sub-pattern region 60 and second sub-pattern region 61. The first sub-pattern region 60 comprises a first set of parallel rows of raised protrusion areas 20 and connecting elements 30 and a second set of parallel rows of raised protrusions 20 and connecting elements 30 which are not parallel to the first set of parallel rows. The first sub-pattern region 60 is structurally distinguishable from the second sub-pattern region 61.

The structure of the present invention may vary in size depending on the desired use for the dynamic image conveyed by the present invention. It may be relatively small, such as on the surface of a security card, or it may be relatively large, such as a pattern on a wall. The present invention contemplates any use of the three-dimensional structured image on any product on which it is desired to have a dynamic visual image.

Figure 2:
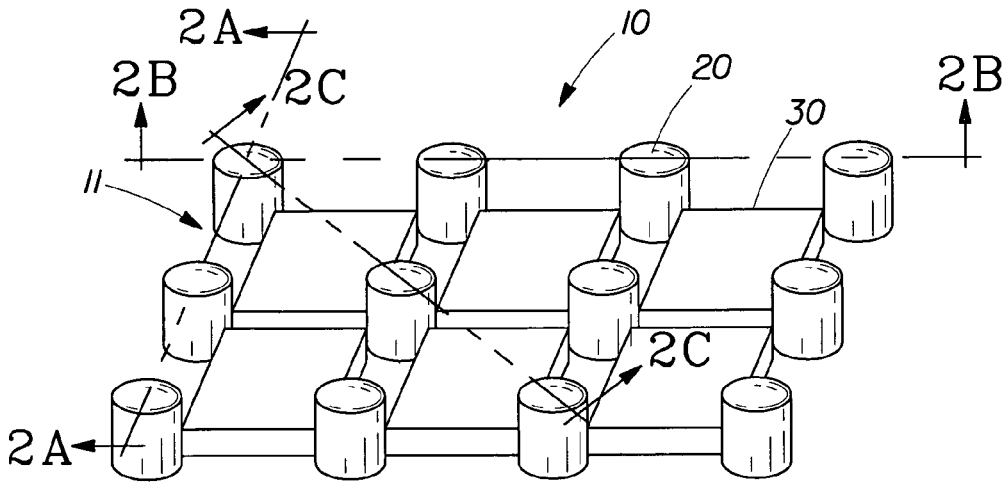
FIG. 2 is a schematic representation of another embodiment of a three-dimensional product according to the present invention having a structure which provides a dynamic visual image on the surface of the product.
Figure 2A:
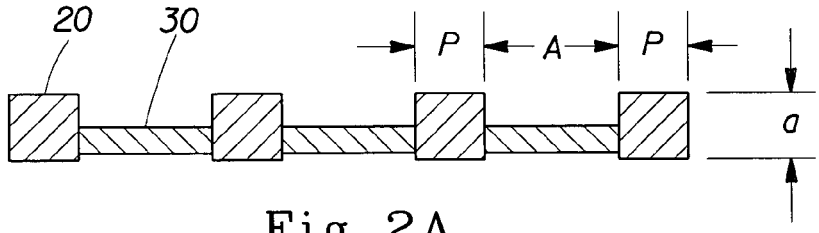
FIGS. 2A-A, 2B-B, and 2C-C are cross-sectional views of the three-dimensional product of FIG. 2.
Figure 2B:
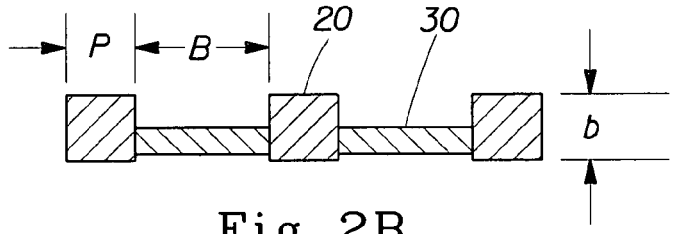

FIG. 1 and FIG. 2 depict two embodiments of the three-dimensional product 10 of the present invention. The product 10 comprises a structure 15 having a first surface 11 and a second surface 12. The product can be any product with surfaces that may be made aesthetically more appealing by the addition of a visually dynamic image to its surface. These could be, without limitation, plastic card products, paper products, wall papers, or architectural elements such as a wall or a ceiling. The product 10 may be produced by any method know in the appropriate industry for producing three-dimensional products. This includes producing the product in sheet or roll form, in a stamped or molded blank form, or by assembly of the product from individual parts.

The three-dimensional product 10 of the present invention comprises a structure 15 having a first surface 11 which comprises the protrusion areas 20 and connecting elements 30 in a pattern that create the visually dynamic image. The surface 11 generally is flat and therefore has two dimensions, a length and a width. However, it is possible that surface may be either cylindrically or spherically concave or convex or otherwise slightly irregular. In fact, the surface may be a mixture of any of these orientations. At any point on the surface, however, the z-direction is perpendicular to the surface of the product at the point in question. The z-direction is generally understood to be the direction coming out (positive z-direction) of or moving into the product surface (negative z-direction) when viewed from one side of the surface, whether the surface, at a given point is best represented by rectangular, cylindrical or spherical coordinates.

The structure 15 of the product comprises a base 50 which is the portion of the structure that is located the furthest distance away from the viewer in the negative z-direction. The base 50 may be a plurality of points or flat regions located in the valleys between the protrusions 20 and connecting elements 30. It is not necessary for all of the localized base regions to be at exactly the same z-dimension location across the entire pattern or sub-pattern region.

The structure 15 of the product 10 also comprises a plurality of raised protrusion areas 20 or protrusions. The raised protrusion areas 20 are portions of the structure formed in discrete peaks or plateaus above the base 50 of the structure 15. The actual shape of the top area of the protrusion may be round, elliptical, square, rectangular, or any other shape. The raised protrusion areas are at a distance in the positive z-direction or "height" of at least about 300 μm, preferably at least about 650 μm, more preferably at least about 1000 μm, and most preferably at least about 1250 μm. When the height of the protrusions is less than 5000 μm, the height may be measured the Primos Height Test using a GFM Primos Optical Profiler as described in the Test Methods herein.

The structure 15 further comprises a plurality of connecting elements 30. Each connecting element 30 is a portion of the structure material that is generally linear, when viewed from above, having its ends at a raised protrusion area 20. Thereby, each connecting element 30 runs between two raised protrusion areas 20. The connecting elements 30 are raised above the base in the z-direction, but at least a portion of the span of the individual connecting elements 30 are recessed below the tops of the protrusions 20 they connect. The character of being recessed below the tops of the protrusions includes the situation where the ends of the connecting elements are at the same height of the protrusion tops as is illustrated in FIG. 1. The connecting elements may be any cross-sectional shape when viewed end-on.

The protrusions 20 and connecting elements 30 of the three-dimensional product may be arranged to form a pattern of multiple parallel rows of alternating protrusions and connecting elements. By the term "row", it is meant a set of uninterrupted protrusions and connecting elements joining those elements into a sequence or string of elements. The rows may be linear, curvilinear or mixtures thereof. By "parallel rows" it is meant that two or more of these rows of protrusion and connecting elements run along side one another generally maintaining a constant spacing between two rows. In one embodiment, the multiple parallel rows may be two or more linear rows running in parallel in the rectangular sense. In another embodiment the multiple parallel rows may be two of more curvilinear rows each following a similar curvilinear path at generally constant spacing between rows.

Figure 1C:
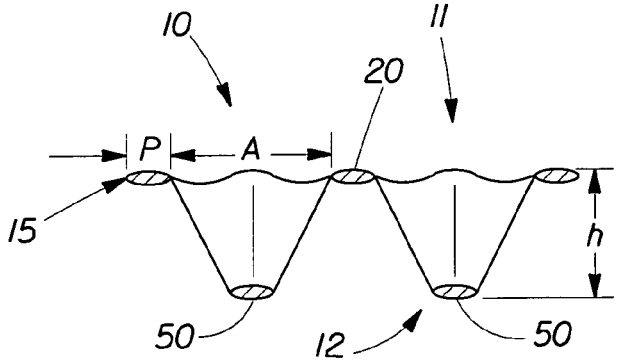
Figure 2C:
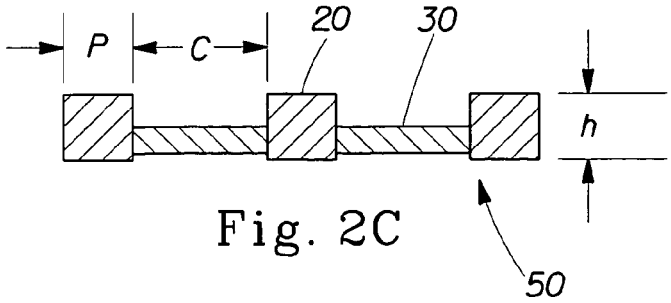

The general structure of one of these rows is represented in FIGS. 1A-A, 1B-B, 2A-A, and 2B-B, which are cross-sectional profiles along the row. The length of the protrusion is represented by P. The length of the connecting element is represented by A or B and the depth of the recession of the connecting element from the protrusion is represented by a or b. P is not required to have the same value along all of the rows. Cross-sections of the three-dimensional structure showing a line between protrusions 20 and the base 50 is shown in FIGS. 1C-C and 2C-C. The distance between the protrusions in this direction is dependent on the desired dimensions of the chosen rows of protrusions and connecting elements. The height of the protrusions above the base is represented by h, which is greater than about 300 μm.

Figure 3:
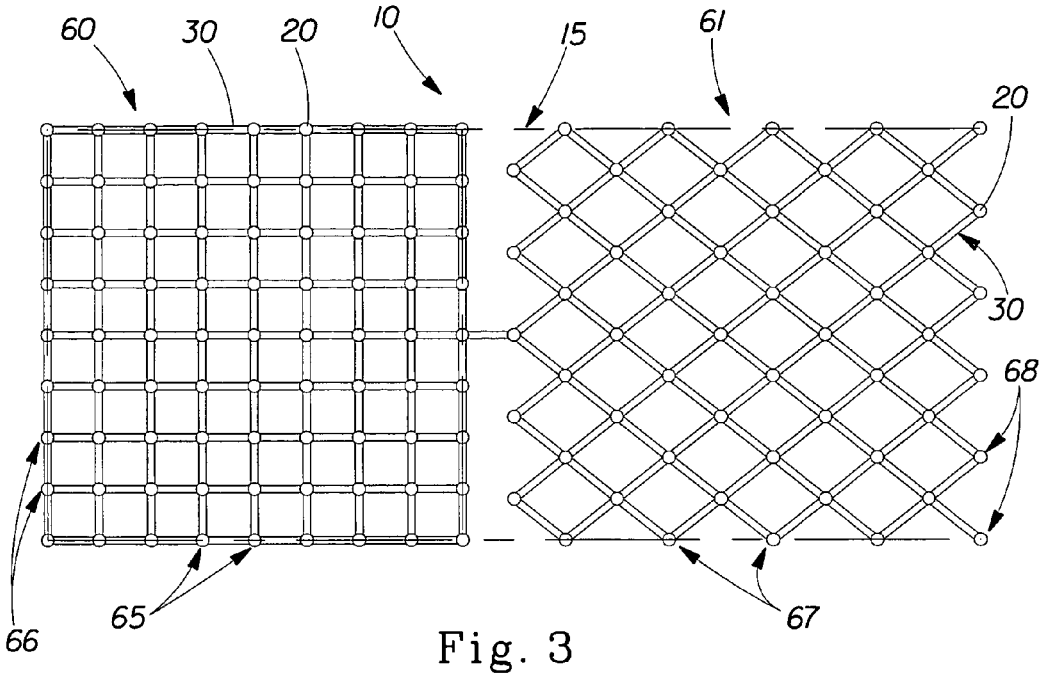
FIG. 3 is a top view representation of two examples of sub-pattern regions of protrusions and connecting elements of the present invention.
Figure 4:
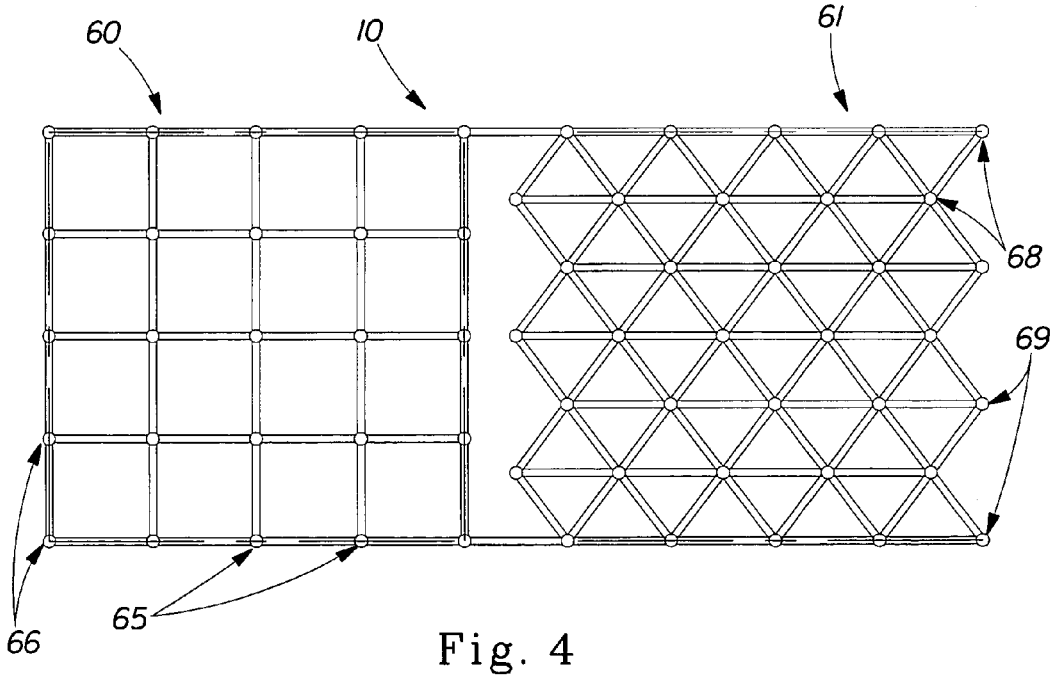
FIG. 4 is a top view representation of two other examples of sub-pattern regions of protrusions and connecting elements of the present invention.

The product comprises at least two sub-pattern regions 60 and 61 wherein the first sub-pattern region 60 is structurally distinguishable from the second sub-pattern region 61. Sub-pattern regions may be distinguishable in any manner such that the regions appear different to a viewer. The structural distinctions may include having a pattern of protrusions 20 and connecting elements 30 in the first sub-pattern region 60 and no protrusions and connecting elements in the second sub-pattern region 61. The distinction may also include the rotation of a first sub-pattern to achieve a second sub-pattern region where the sets of parallel row within each sub-pattern region are not parallel to each other. Other structural distinctions may also include an alteration of the first pattern to achieve the second; a change in magnification, magnification or reduction, of a pattern from one region to the second; having a completely different pattern in one region from the second; or a mixture of these with or without rotation. Preferably, the first sub-pattern region 60 comprises at least two sets of parallel rows of alternating protrusions 20 and connecting elements 30, and the second sub-pattern region 61 comprises at least two sets of parallel rows of alternating protrusions 20 and connecting elements 30 which are not parallel to the sets of parallel rows in the first sub-pattern region 60. FIG. 3 and FIG. 4, illustrate embodiments of these sets of parallel rows with rows 65 and 66 in sub-pattern region 60, and 67, 68, and optionally 69 in sub-pattern region 61.

Within a sub-pattern region, it is believed, without being limited by theory, that these specific combinations of structural elements change the visual impact of the various patterns. For example, when one of the sets of parallel rows of alternating protrusions and connecting elements is viewed at an angle across the direction of the rows in overhead lighting, the height differential between the protrusions and the connecting elements may be minimized by the eye when compared against the height differential in the valley from the top of the row formed by the protrusions and connecting elements to the base. Under these conditions the linear character of the row dominates and that particular structure looks more like a row to the eye. By contrast, when the parallel rows are viewed at an angle along the direction of the rows in overhead lighting, the height differential between the protrusions and connecting elements may interfere with the linear aspect of the rows to the eyes, making it appear that the rows soften or even disappear under some conditions, such that other elements of the pattern become more dominant to the eye.

When a second set of parallel rows of protrusions and connecting elements is built into the pattern of the sub-pattern region, this changing of dominant and softened characteristics of linearity of the row may result in a dynamically changing image to the eye. At one combination of lighting angle and viewing angle the dominant linearity of the first set of elements presents an image in the form of those elements. However, at a second combination of lighting angle and viewing angle the dominant linearity of the second set of elements presents an image in the form of those second row elements.

The visually dynamic effect on the surface of the three-dimensional product may be accentuated by repeating the sub-pattern regions throughout the overall pattern. The repeating pattern may be in any direction across the surface of the product, in that is can be regularly repeated in a pattern along the length of the product, along the width of the product or along both the length or width of the product. The repeating pattern may alternatively be an irregular repeat of the sub-pattern regions or combination of sub-pattern regions on the surface of the product.

Figure 7:
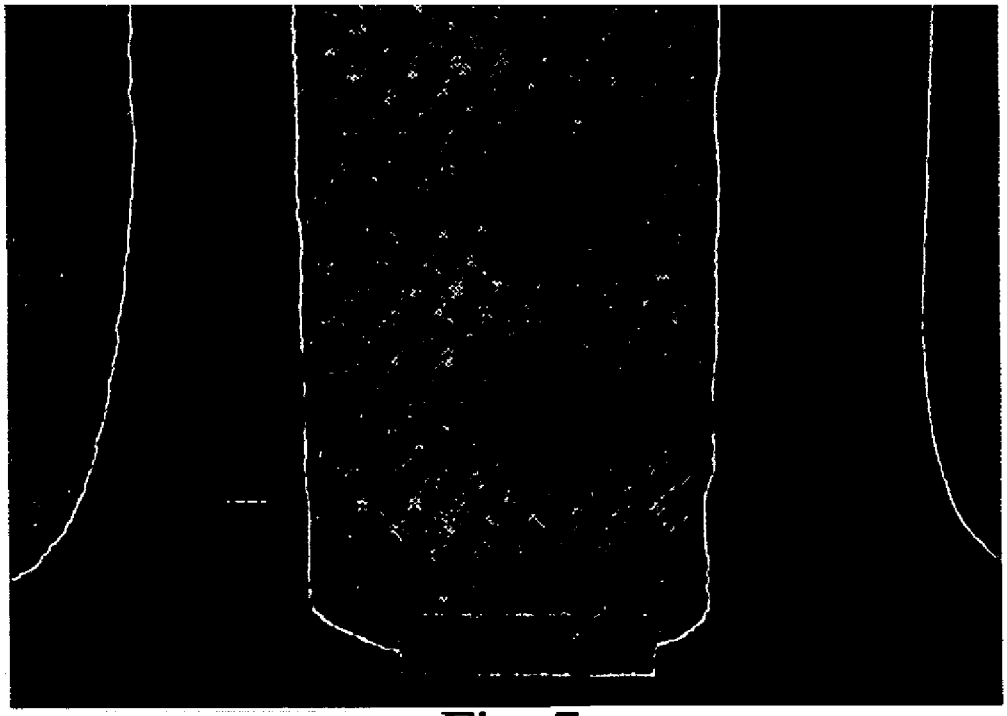
FIG. 7 is a photograph of a three-dimensional paper product illustrating one communicated image when viewed in one orientation.
Figure 8:
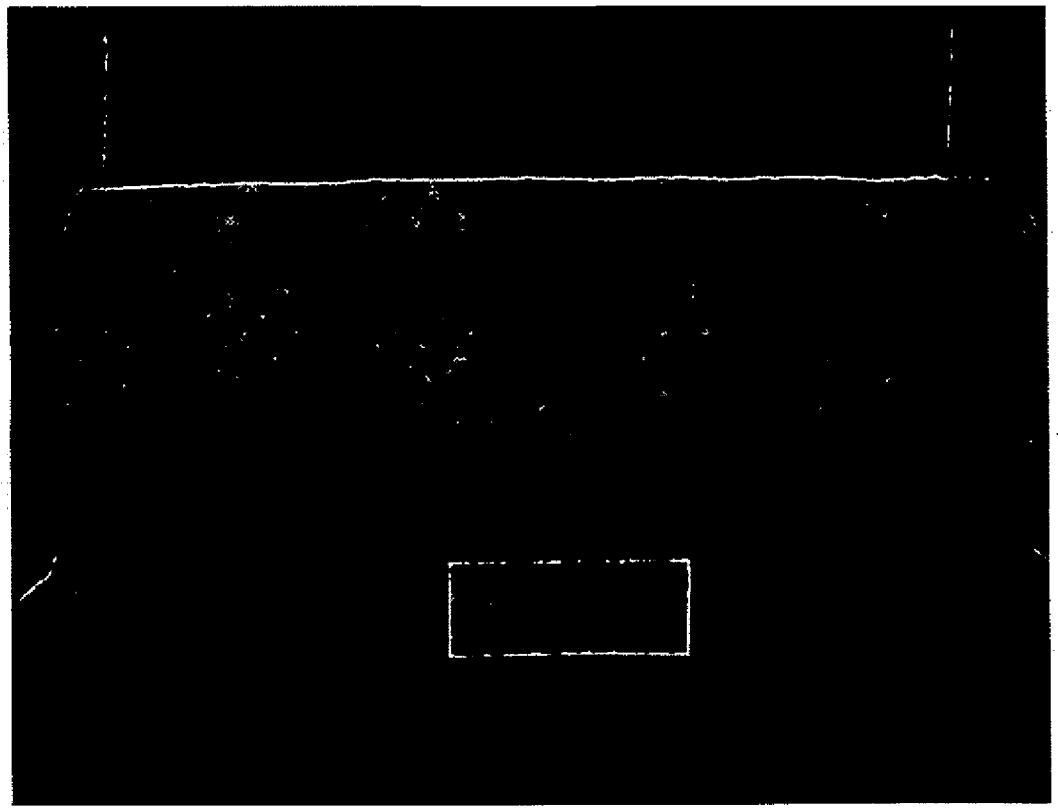
FIG. 8 is a photograph of the same three-dimensional paper product from FIG. 7 illustrating a second communicated image when viewed at an orientation rotated 90° around the z-direction of the product from the orientation in FIG. 7.

As a result of these three-dimensional patterns of protrusion and connecting elements it is now possible to create a product which conveys more than one communicated image by simply either rotating the viewing angle of the product, or altering the lighting angle or intensity. Rotation of the viewing angle may involve a rotation of the product around the z-dimension of the product, a change of viewing angle between the z-coordinate and the viewing line, the change in the surface topography (e.g., the changing of the product from a flat product to a cylindrical roll), or combinations of these. One example of this can be seen in the photographs of a tissue-towel paper embodiment shown in FIG. 7 and FIG. 8 where two distinct images can be seen presented on the same product roll by simply rotating the product roll by 90° around the z-dimension of the product. These three-dimensional patterns may be used to create multiple communications of images by rotating a rolled product around its cylindrical axis while viewing the product from a normal position to the product, i.e. along the z-coordinate of the product.

EMBODIMENTS

As discussed above, the three-dimensional product of the present invention may vary in size depending on the desired use for the dynamic image conveyed by the present invention. It may be relatively small, such as on the surface of a security card, or it may be relatively large, such as a pattern on a wall. The present invention contemplates any use of the three-dimensional structured image on any product on which it is desired to have a dynamic visual image. As such, any material may be used to form the structure for the three-dimensional product of the present invention. Analogously, any process for creating three-dimensional structures may be used to create the structural elements of the present invention to create the dynamic visual image. The desired process may be determined based on, without limitation, the size, durability, and proposed use of the product.

Possible materials for the structure may comprise any material, including, but not limited to, paper, polymeric or plastic films, cloths or fabrics, wovens, nonwovens, laminates, metal foils such as aluminum foil, coated papers, such as wax paper or grease-proof paper, and combinations thereof. The properties of a selected material web can include, though are not restricted to, combinations or degrees of being: porous, non-porous, microporous, gas or liquid permeable, non-permeable, hydrophilic, hydrophobic, hygroscopic, oleophilic, oleophobic, high critical surface tension, low critical surface tension, surface pre-textured, elastically yieldable, plastically yieldable, electrically conductive, and electrically non-conductive.

Useful plastic films include, but are not limited to, polyethylene, ethylene copolymers such as ethylene-vinyl acetate (EVA), polypropylene, polyester (PET), polyvinyl chloride (PVC), polyvinylidene chloride and copolymers (PVDC), latex structures, polystyrene, nylon, etc. Polyolefins are generally preferred due to their lower cost and ease of forming. Preferred material gauges are about 0.0001 inches (0.0025 mm) to about 0.010 inches (0.25 mm). More preferred gauges are from about 0.0002 inches (0.005 mm) to about 0.002 inches (0.051 mm). Even more preferred gauges are from about 0.0003 inches (0.0076 mm) to about 0.001 inches (0.025 mm). The preferred material is 0.0007 inch (0.0178 mm) nominal thickness high density polyethylene (HDPE).

For some embodiments of the three-dimensional product the structure of the present invention the height of the raised protrusion areas 20 above the base 50 may range from about 300 μm to about 2500 μm, preferably from about 650 μm to about 1500 μm. The protrusions may be circular, having a diameter, P, greater than about 500 μm, preferably ranging from about 500 μm to about 4000 μm, more preferably from about 1000 μm to about 2500 μm. The lengths of the connecting elements, A and B, may range from about 1000 μm to about 12000 μm, preferably from about 1500 μm to about 6000 μm, and more preferably 1500 μm to about 4500 μm. The depth of the recession of the connecting element 30 from the raised protrusion areas 20, a and b, may be greater than about 150 μm, preferably ranging from about 200 μm to about a value equal to 95% of the protrusion height, h, more preferably from about 300 μm to about 90% of h, and most preferably ranging from about 300 μm to about 1400 μm.

In one embodiment, the three dimensional product is a tissue-towel paper product. As used herein, the phrase "tissue-towel paper product" refers to products comprising paper tissue or paper towel technology in general, including but not limited to conventionally felt-pressed or conventional wet pressed tissue paper; pattern densified tissue paper, through-air dried paper; and high-bulk, uncompacted tissue paper. Non-limiting examples of tissue-towel products include toweling, facial tissue, bath tissue, and table napkins and the like.

The structure of the tissue-towel paper product embodiment may include one or more plies of a fibrous sheet made from any tissue paper technology known in the art. The term "ply" or "plies" means an individual sheet of formed fibers having the use as a tissue product. As used herein, the ply may comprise one or more wet-laid layers. When more than one wet-laid layer is used, it is not necessary that they are made from the same fibrous structure. Further, the layers may or may not be homogeneous within the layer. The actual make up of the tissue paper ply is determined by the desired benefits of the final tissue paper product. The tissue paper is an arrangement of fibers produced in any typical papermaking machine known in the art to create the ply of tissue-towel paper. Applicable wood pulps include chemical pulps, such as Kraft, sulfite, and sulfate pulps, as well as mechanical pulps including, for example, groundwood, thermomechanical pulp and chemically modified thermomechanical pulp. Also applicable to the present invention are fibers derived from recycled paper, which may contain any or all of the above categories as well as other non-fibrous materials such as fillers and adhesives used to facilitate the original papermaking. In addition to the above, fibers and/or filaments made from polymers, specifically hydroxyl polymers may be used in the present invention. Nonlimiting examples of suitable hydroxyl polymers include polyvinyl alcohol, starch, starch derivatives, chitosan, chitosan derivatives, cellulose derivatives, gums, arabinans, galactans and mixtures thereof.

Tissue-towel paper product embodiments may comprise any tissue paper product known in the industry. These embodiments may be made according U.S. Pat. No. 4,191,609 issued Mar. 4, 1980 to Trokhan; U.S. Pat. No. 4,300,981 issued to Carstens on Nov. 17, 1981; U.S. Pat. No. 4,191,609 issued to Trokhan on Mar. 4, 1980; U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,245,025 issued to Trokhan et al. on Sep. 14, 1993; U.S. Pat. No. 5,275,700 issued to Trokhan on Jan. 4, 1994; U.S. Pat. No. 5,328,565 issued to Rasch et al. on Jul. 12, 1994; U.S. Pat. No. 5,334,289 issued to Trokhan et al. on Aug. 2, 1994; U.S. Pat. No. 5,364,504 issued to Smurkowski et al. on Nov. 15, 1995; U.S. Pat. No. 5,527,428 issued to Trokhan et al. on Jun. 18, 1996; U.S. Pat. No. 5,556,509 issued to Trokhan et al. on Sep. 17, 1996; U.S. Pat. No. 5,628,876 issued to Ayers et al. on May 13, 1997; U.S. Pat. No. 5,629,052 issued to Trokhan et al. on May 13, 1997; U.S. Pat. No. 5,637,194 issued to Ampulski et al. on Jun. 10, 1997; U.S. Pat. No. 5,411,636 issued to Hermans et al. on May 2, 1995; EP 677612 published in the name of Wendt et al. on Oct. 18, 1995.

The tissue-towel substrate may be through-air-dried or conventionally dried. Optionally, it may be foreshortened by creping or by wet microcontraction. Examples of creping and/or wet microcontraction are disclosed in commonly assigned U.S. Pat. No. 6,048,938 issued to Neal et al. on Apr. 11, 2000; U.S. Pat. No. 5,942,085 issued to Neal et al. on Aug. 24, 1999; U.S. Pat. No. 5,865,950 issued to Vinson et al. on Feb. 2, 1999; U.S. Pat. No. 4,440,597 issued to Wells et al. on Apr. 3, 1984; U.S. Pat. No. 4,191,756 issued to Sawdai on May 4, 1980; and U.S. Ser. No. 09/042,936 filed Mar. 17, 1998 now U.S. Pat. No. 6,187,138.

Conventionally pressed tissue paper and methods for making such paper are known in the art. See commonly assigned U.S. patent application Ser. No. 09/997,950 filed Nov. 30, 2001 now U.S. Pat. No. 6,547,928. One suitable tissue-towel paper is pattern densified tissue paper which is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Ayers on Aug. 10, 1976, U.S. Pat. No. 4,191,609, issued to on Mar. 4, 1980, and U.S. Pat. No. 4,637,859, issued to on Jan. 20, 1987; U.S. Pat. No. 3,301,746, issued to Sanford and Sisson on Jan. 31, 1967, U.S. Pat. No. 3,821,068, issued to Salvucci, Jr. et al. on May 21, 1974, U.S. Pat. No. 3,974,025, issued to Ayers on Aug. 10, 1976, U.S. Pat. No. 3,573,164, issued to Friedberg, et al. on Mar. 30, 1971, U.S. Pat. No. 3,473,576, issued to Amneus on Oct. 21, 1969, U.S. Pat. No. 4,239,065, issued to Trokhan on Dec. 16, 1980, and U.S. Pat. No. 4,528,239, issued to Trokhan on Jul. 9, 1985.

Uncompacted, non pattern-densified tissue paper structures are also contemplated to be within the scope of the present invention and are described in U.S. Pat. No. 3,812,000 issued to Joseph L. Salvucci, Jr. and Peter N. Yiannos on May 21, 1974, and U.S. Pat. No. 4,208,459, issued to Henry E. Becker, Albert L. McConnell, and Richard Schutte on Jun. 17, 1980.

The tissue paper embodiment can also be produced from uncreped tissue paper. Uncreped tissue paper, a term as used herein, refers to tissue paper which is non-compressively dried, most preferably by through air drying. Resultant through air dried webs are pattern densified such that zones of relatively high density are dispersed within a high bulk field, including pattern densified tissue wherein zones of relatively high density are continuous and the high bulk field is discrete. The techniques to produce uncreped tissue in this manner are taught in the prior art. For example, Wendt, et. al. in European Patent Application 0 677 612A2, published Oct. 18, 1995; Hyland, et. al. in European Patent Application 0 617 164 A1, published Sep. 28, 1994; and Farrington, et. al. in U.S. Pat. No. 5,656,132 published Aug. 12, 1997.

The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex®, available from Hercules, Inc. (Wilmington, Del.).

Other materials can be added to the aqueous papermaking furnish or the embryonic web to impart other desirable characteristics to the product or improve the papermaking process. See, for example, U.S. Pat. No. 5,221,435, issued to Smith on Jun. 22, 1993; U.S. Pat. No. 3,700,623, issued on Oct. 24, 1972, and U.S. Pat. No. 3,772,076, issued on Nov. 13, 1973, both to Keim; U.S. Pat. No. 4,981,557, issued on Jan. 1, 1991, to Bjorkquist; U.S. Pat. No. 4,011,389, issued to Langdon, et al. on Mar. 8, 1977; and U.S. Pat. No. 5,611,890, issued to Vinson et al. on Mar. 18, 1997.

Another class of suitable substrates for use in the process of the present invention is non-woven webs comprising synthetic fibers. Examples of such substrates include but are not limited to textiles (e.g.; woven and non woven fabrics and the like), other non-woven substrates, and paperlike products comprising synthetic or multicomponent fibers. Representative examples of other preferred substrates can be found in U.S. Pat. No. 4,629,643 issued to Curro et al. on Dec. 16, 1986; U.S. Pat. No. 4,609,518 issued to Curro et al. on Sep. 2, 1986; European Patent Application EP A 112 654 filed in the name of Haq; copending U.S. patent application Ser. No. 10/360,038 filed on Feb. 6, 2003 now U.S. Pat. No. 7,052,580 in the name of Trokhan et al.; copending U.S. patent application Ser. No. 10/360,021 filed on Feb. 6, 2003 now U.S. Pat. No. 7,067,038 in the name of Trokhan et al.; copending U.S. patent application Ser. No. 10/192,372 filed in the name of Zink et al. on Jul. 10, 2002 now U.S. Pat. No.

6,986,932; and copending U.S. patent application Ser. No. 09/089,356 filed in the name of Curro et al. on Dec. 20, 2000 now abandoned.

Figure 9:
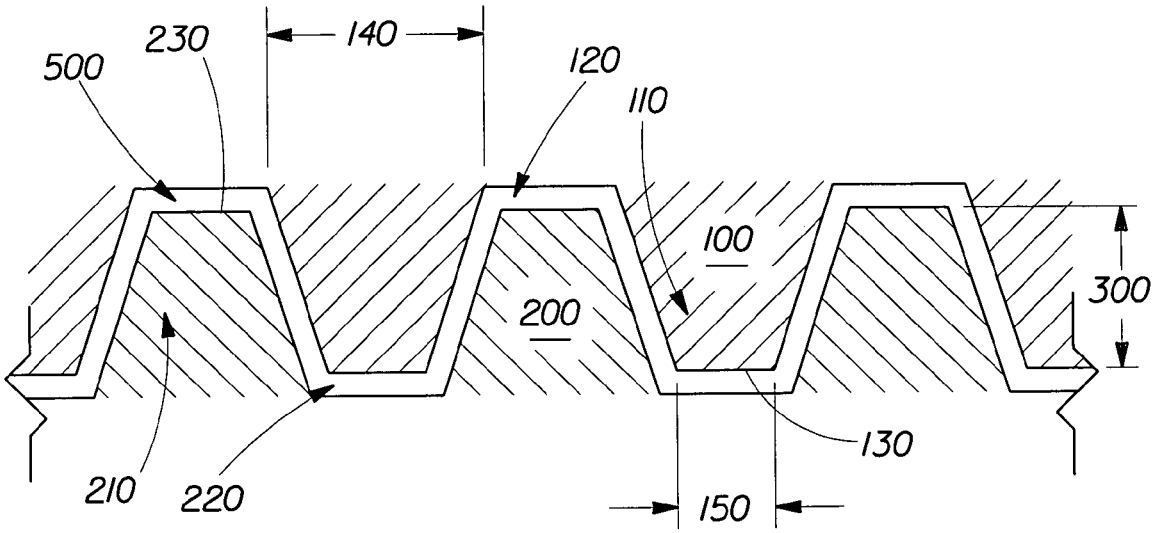
FIG. 9 is a side view of the gap between two engaged emboss rolls of a deep nested embossing process which may be used to produce one embodiment of the present invention.

The structure of the base 50, protrusions 20 and connecting elements 30 for the tissue-towel paper product embodiment of the product of the present invention may be formed in any paper forming process known in the industry. These include without limitation wet-forming during paper making or embossing finished paper. One suitable process of forming the three-dimensional structure of the present invention is deep nested embossing. Any deep nested embossed technology known in the industry may be used. FIG. 9 illustrates the nip of two embossing rolls where a deep nested pattern is formed into any material to be embossed. The structure 15 is embossed in the gap 500 between two embossing rolls, 100 and 200. The embossing rolls may be made from any material known for making such rolls, including without limitation steel, rubber, elastomeric materials, and combinations thereof. Each embossing roll 100 and 200 have a combination of emboss knobs 110 and 210 and gaps 120 and 220. Each emboss knob has a knob base 140 and a knob face 150. The surface pattern of the rolls, that is the design of the various knobs and gaps, may be any design desired for the product, however for the deep nested process the roll designs should be matched such that the knob face of one roll 130 extends into the gap of the other roll beyond the knob face of the other roll 230 creating a depth of engagement 300. The depth of engagement 300 is the distance between the nested knob faces 130 and 230. The depth of the engagement 300 used in producing the paper products of the present invention can range from about 1016 μm (0.04 inch) to about 2032 μm (0.08 inch), and preferably from about 1270 μm (0.05 inch) to about 1778 μm (0.07 inch), such that an embossed height of at least 300 μm is formed the surface of the fibrous structure of the one-ply tissue-towel product.

Embodiment 1

One fibrous structure useful in a tissue-towel paper product of the present invention is a through-air dried (TAD), differential density structure as described in U.S. Pat. No. 4,528,239. Such a structure may be formed, for example, by the following process.

A pilot scale Fourdrinier, through-air-dried papermaking machine may be used to make a paper web. A slurry of papermaking fibers is pumped to the headbox at a consistency of about 0.15%. The slurry consists of about 60% Northern Softwood Kraft fibers, refined to a Canadian standard freeness of about 500 ml, and about 40% unrefined Southern Softwood Kraft fibers. The fiber slurry contains a cationic polyamine-epichlorohydrin wet strength resin at a concentration of about 25 lb. per ton of dry fiber, and carboxymethyl cellulose at a concentration of about 6.5 lb. per ton of dry fiber.

Dewatering occurs through the Fourdrinier wire and is assisted by vacuum boxes. The wire is of a configuration having 84 machine direction and 78 cross direction filaments per inch, such as that available from Albany International known at 84×78-M.

The embryonic wet web is transferred from the Fourdrinier wire at a fiber consistency of about 22% at the point of transfer, to a TAD carrier fabric. The wire speed is about 6% faster than the carrier fabric so that wet shortening of the web occurs at the transfer point. The sheet side of the carrier fabric consists of a continuous, patterned network of photopolymer resin, said pattern containing about 330 deflection conduits per inch. The deflection conduits are arranged in a bi-axially staggered configuration, and the polymer network covers about 25% of the surface area of the carrier fabric. The polymer resin is supported by and attached to a woven support member consisting of 70 machine direction and 35 cross direction filaments per inch. The photopolymer network rises about 0.008" above the support member.

The consistency of the web is about 65% after the action of the TAD dryers operating about a 450 F, before transfer onto the Yankee dryer. An aqueous solution of creping adhesive consisting of polyvinyl alcohol is applied to the Yankee surface by spray applicators at a rate of about 5 lb. per ton of production. The Yankee dryer is operated at a speed of about 600 fpm. The fiber consistency is increased to an estimated 99% before creping the web with a doctor blade. The doctor blade has a bevel angle of about 25 degrees and is positioned with respect to the Yankee dryer to provide an impact angle of about 81 degrees. The Yankee dryer is operated at about 315□F, and Yankee hoods are operated at about 350□F. The dry, creped web is passed between two calendar rolls operated at 540 fpm, so that there is net 6% foreshortening of the web by crepe.

Figure 5:
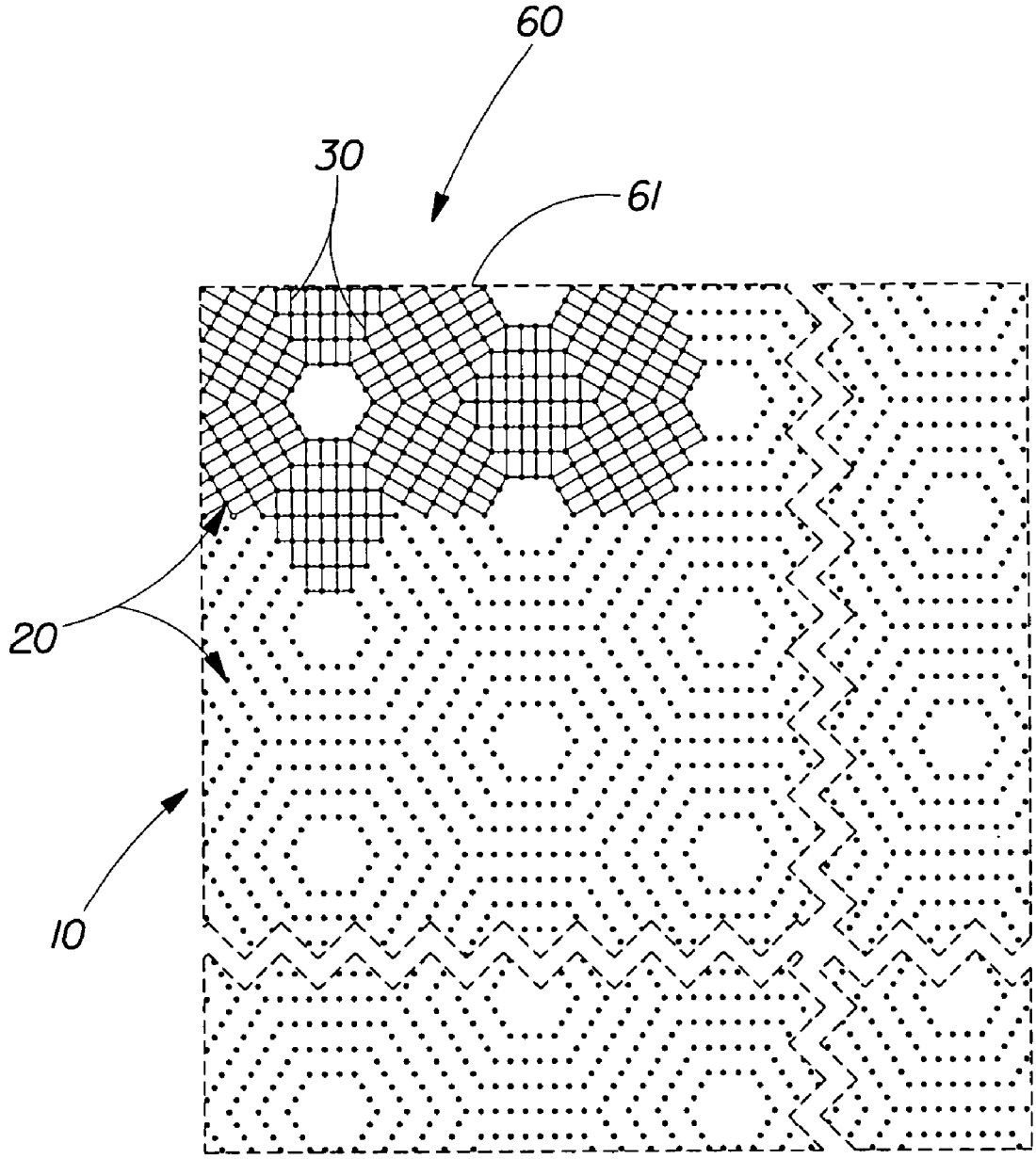
FIG. 5 is a top view representation of a pattern of protrusions for one embodiment of the present invention with representations of the pattern of connecting elements demonstrating the first and second sub-patterns of the overall pattern.
Figure 6:
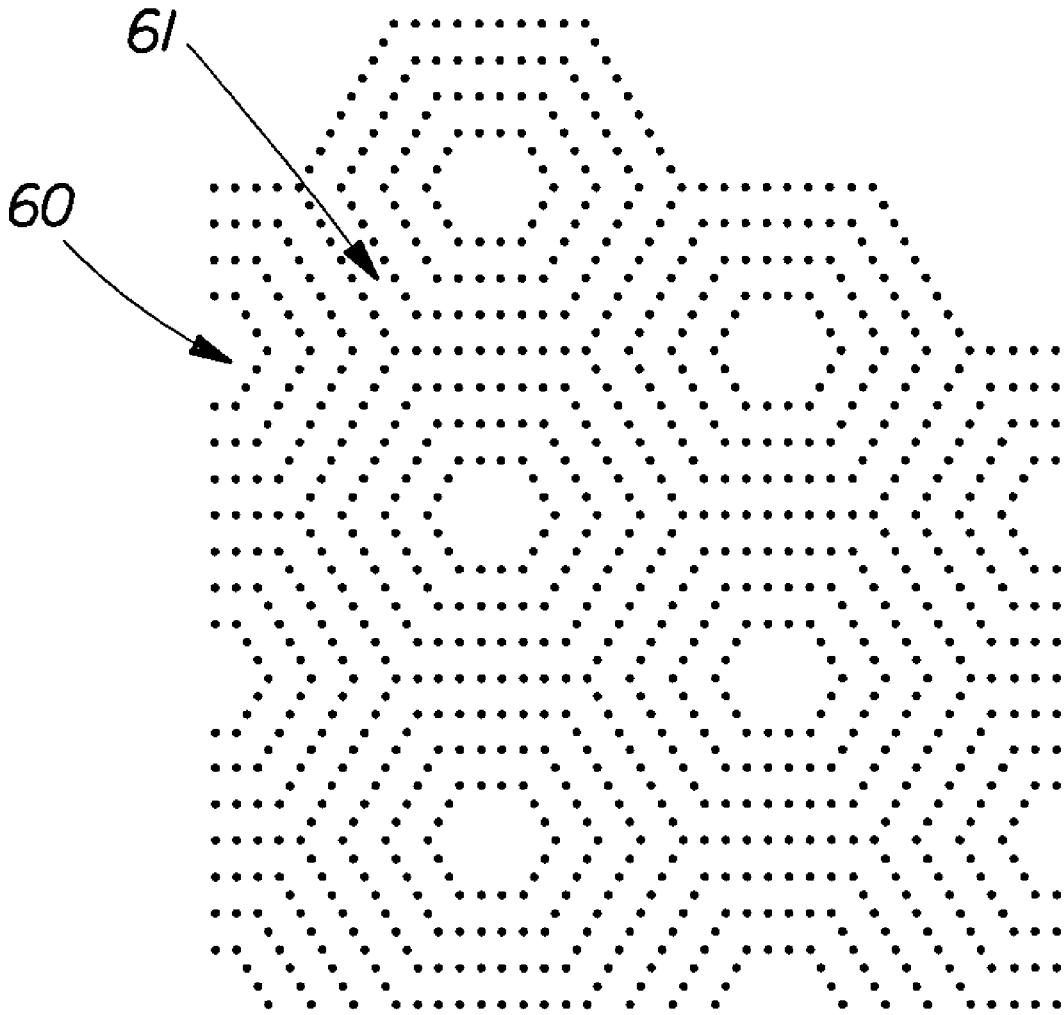
FIG. 6 is a representation of a deep nested embossing pattern used to create an embodiment of the three-dimensional product of the present invention.

The paper described above is further subjected to a deep embossing process to form the three-dimensional structure pattern of the present invention. Two emboss rolls are engraved with complimentary, nesting protrusions in the pattern represented in FIG. 6 where the blue dots represent emboss roll protrusions on the first emboss roll and the red dots represent emboss roll protrusions on the second emboss roll. Said protrusions are frustaconical in shape, with a face diameter of about 0.063" and a floor diameter of about 0.121." The height of the protrusions on each roll is about 0.085." In this embodiment the connecting elements of the structure are formed by the counteracting stresses between the offset protrusions of the first and second emboss rolls. The resulting three-dimensional product is represented in FIG. 5 which illustrates the pattern of protrusions 20 and connecting elements 30 arranged in a first sub-pattern region 60 and a second sub-pattern region 61 each of which has two rows of protrusions 20 and connecting elements 30 which provides the visually dynamic image of this particular embodiment of the present invention.

The engagement of the nested rolls may be set to about 0.065," and the paper described above may be fed through the engaged gap at a speed of about 120 fpm. The resulting paper would have a protrusion height of greater than about 300 μm having a diameter, P, ranging from about 1000 μm to about 2500 μm. The lengths of the connecting elements, A and B, may range from about 1500 μm to about 4500 μm. The depth of the recession of the connecting element from the raised protrusion areas, a and b, may range from about 300 μm to about 1400 μm.

Embodiment 2

Another example of a through-air dried, differential density structure, as described in U.S. Pat. No. 4,528,239, may be formed by the following process. The TAD carrier fabric of Example 1 is replaced with a carrier fabric consisting of 225 bi-axially staggered deflection conduits per inch, and a resin height of about 0.012". This paper is further subjected to the embossing process of Embodiment 1 to form the three-dimensional structure of the present invention having a protrusion height of greater than 300 μm. The resulting paper would have a protrusion height of greater than about 300 μm having a diameter, P, ranging from about 1000 μm to about 2500 μm. The lengths of the connecting elements, A and B, may range from about 1500 μm to about 4500 μm.

The depth of the recession of the connecting element from the raised protrusion areas, a and b, may range from about 300 μm to about 1400 μm.

Embodiment 3

An alternative embodiment of the present fibrous structure is a paper structure having a wet microcontraction greater than about 5% in combination with any known through air dried process. Wet microcontraction is described in U.S. Pat. No. 4,440,597. An example of Embodiment 3 may be produced by the following process. The wire speed is increased compared to the TAD carrier fabric so that the wet web foreshortening is 10%. The TAD carrier fabric of Embodiment 1 is replaced by a carrier fabric having a 5-shed weave, 36 machine direction filaments and 32 cross-direction filaments per inch. The net crepe for shortening is 20%. This paper is further subjected to the embossing process of Example 1, and the resulting paper has a protrusion height of greater than 650 μm. The resulting paper would have a protrusion height of greater than about 300 μm having a diameter, P, ranging from about 1000 μm to about 2500 μm. The lengths of the connecting elements, A and B, may range from about 1500 μm to about 4500 μm. The depth of the recession of the connecting element from the raised protrusion areas, a and b, may range from about 300 μm to about 1400 μm.

Embodiment 4

Another embodiment of a fibrous structure suitable for use in the present invention is the through air dried paper structures having MD impression knuckles, as described in U.S. Pat. No. 5,672,248. A commercially available single-ply substrate made according to U.S. Pat. No. 5,672,248 having a basis weight of about 25 lb/3000 square feet, a wet burst strength of about 340 g, a caliper of about 0.032", and a CD peak elongation of about 12%, sold under the Tradename Scott and manufactured by Kimberly Clark Corporation is subjected to the embossing process of Embodiment 1. The resulting paper has a protrusion height of greater than 300 μm. The resulting paper would have a protrusion height of greater than about 300 μm having a diameter, P, ranging from about 1000 μm to about 2500 μm. The lengths of the connecting elements, A and B, may range from about 1500 μm to about 4500 μm. The depth of the recession of the connecting element from the raised protrusion areas, a and b, may range from about 300 μm to about 1400 μm.

Test Methods

Primos Height Test Method

Height is measured using a GFM Primos Optical Profiler instrument commercially available from GFMesstechnik GmbH, Warthestraβe 21, D14513 Teltow/Berlin, Germany. The GFM Primos Optical Profiler instrument includes a compact optical measuring sensor based on the digital micro mirror projection, consisting of the following main components: a) DMD projector with 1024×768 direct digital controlled micro mirrors, b) CCD camera with high resolution (1300×1000 pixels), c) projection optics adapted to a measuring area of at least 27×22 mm, and d) recording optics adapted to a measuring area of at least 27×22 mm; a table tripod based on a small hard stone plate; a cold light source; a measuring, control, and evaluation computer; measuring, control, and evaluation software ODSCAD 4.0, English version; and adjusting probes for lateral (x-y) and vertical (z) calibration.

The GFM Primos Optical Profiler system measures the surface height of a sample using the digital micro-mirror pattern projection technique. The result of the analysis is a map of surface height (z) vs. xy displacement. The system has a field of view of 27×22 mm with a resolution of 21 microns. The height resolution should be set to between 0.10 and 1.00 micron. The height range is 64,000 times the resolution.

To measure a fibrous structure sample, the following steps should be followed:

1. Turn on the cold light source. The settings on the cold light source should be 4 and C, which should give a reading of 3000K on the display;
2. Turn on the computer, monitor and printer and open the ODSCAD 4.0 Primos Software.
3. Select "Start Measurement" icon from the Primos taskbar and then click the "Live Pic" button.
4. Place a 30 mm by 30 mm sample of fibrous structure product conditioned for two hours at a temperature of 73° F.±2° F. (about 23° C.±1° C.) and a relative humidity of 50%±2% under the projection head and adjust the distance for best focus.
5. Click the "Pattern" button repeatedly to project one of several focusing patterns to aid in achieving the best focus (the software cross hair should align with the projected cross hair when optimal focus is achieved). Position the projection head to be normal to the sample surface.
6. Adjust image brightness by changing the aperture on the lens through the hole in the side of the projector head and/or altering the camera "gain" setting on the screen. Do not set the gain higher than 7 to control the amount of electronic noise. When the illumination is optimum, the red circle at bottom of the screen labeled "I.O." will turn green.
7. Select Technical Surface/Rough measurement type.
8. Click on the "Measure" button. This will freeze on the live image on the screen and, simultaneously, the image will be captured and digitized. It is important to keep the sample still during this time to avoid blurring of the captured image. The image will be captured in approximately 20 seconds.
9. If the image is satisfactory, save the image to a computer file with ".omc" extension. This will also save the camera image file ".kam".
10. To move the date into the analysis portion of the software, click on the clipboard/man icon.
11. Now, click on the icon "Draw Cutting Lines". Make sure active line is set to line 1. Move the cross hairs to the lowest point on the left side of the computer screen image and click the mouse. Then move the cross hairs to the lowest point on the right side of the computer screen image on the current line and click the mouse. Now click on "Align" by marked points icon. Now click the mouse on the lowest point on this line, and then click the mouse on the highest point on this line. Click the "Vertical" distance icon. Record the distance measurement. Now increase the active line to the next line, and repeat the previous steps, do this until all lines have been measured (six (6) lines in total. Take the average of all recorded numbers, and if the units is not micrometers, convert it to micrometers (μm). This number is the embossment height. Repeat this procedure for another image in the fibrous structure product sample and take the average of the embossment heights.

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A three-dimensional product comprising a structure having a first surface and a z-direction perpendicular to the first surface, the structure further comprising a base, a plurality of raised protrusion areas raised at least about 300 μm to less than 5,000 μm above the base of the structure, and a plurality of connecting elements, each connecting element ending at a raised protrusion and each connecting element raised above the base of the structure in the z-direction and at least partially recessed from the raised protrusions in the z-direction, wherein the connecting elements connect two of the raised protrusions areas; the plurality of raised protrusion areas and plurality of connecting elements together forming a pattern comprising at least a first sub-pattern region and a second sub-pattern region; wherein the first sub-pattern region comprises a first set or parallel rows of raised protrusion areas and connecting elements and a second set of parallel rows of raised protrusions and connecting elements which are not parallel to the first set of parallel rows and the first sub-pattern region is structurally distinguishable from the second sub-pattern region wherein the structure comprises a tissue-towel paper product and wherein the second sub-pattern region comprises at least two sets of parallel rows of protrusions and connecting elements which are not parallel to the rows in the first sub-pattern region.

2. The three-dimensional product according to claim 1 wherein the first and second sub-pattern regions are structurally distinguishable due to rotation, reduction or magnification, or alteration of the pattern in the first sub-pattern region.

3. The three-dimensional product according to claim 1 wherein the height of the raised protrusion area above the base is at least about 650 μm.

4. The three-dimensional product according to claim 1 wherein the pattern of raised protrusion areas and connecting elements comprises a first sub-pattern region, a second sub-pattern region, and a third sub-pattern region.

5. The three-dimensional product according to claim 1 wherein the pattern comprises a repeating pattern of the first sub-pattern region(s) and the second sub-pattern region(s).

6. The three-dimensional product according to claim 1 wherein the pattern of protrusions and connecting elements is formed by an embossing process.

7. The three-dimensional product according to claim 6 wherein the pattern of protrusions and connecting elements is formed by a deep-nested embossing process.

8. The three dimensional product according to claim 1 wherein the first set of elements and second set of elements are not simultaneously visible under one combination of lighting angle and viewing angle.

* * * * *

UNITED STATES PATENT AND TRADEMARK OFFICE

CERTIFICATE OF CORRECTION

PATENT NO. : 7,320,821 B2
APPLICATION NO. : 10/700131
DATED : January 22, 2008
INVENTOR(S) : Ellyne Elizabeth Prodoehl It is certified that error appears in the above-identified patent and that said Letters Patent is hereby corrected as shown below:

In Col. 10, line 18, the number and symbol "315□F" should be 315°F.
In Col. 10, line 19, the number and symbol "350□F" should be 350°F.

Signed and Sealed this

Twenty-fifth Day of November, 2008

JON W. DUDAS
*Director of the United States Patent and Trademark Office*